US012357143B2

(12) United States Patent
Deng

(10) Patent No.: US 12,357,143 B2
(45) Date of Patent: Jul. 15, 2025

(54) MAINTENANCE STATION AND CLEANING SYSTEM

(71) Applicant: SHENZHEN FLY RODENT DYNAMICS INTELLIGENT TECHNOLOGY CO., LTD., Shenzhen (CN)

(72) Inventor: Wenhai Deng, Shenzhen (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 359 days.

(21) Appl. No.: 17/548,831

(22) Filed: Dec. 13, 2021

(65) Prior Publication Data

US 2022/0395158 A1 Dec. 15, 2022

(30) Foreign Application Priority Data

Jun. 15, 2021 (CN) ..... 202110661229.X

(51) Int. Cl.
*A47L 11/40* (2006.01)
*A47L 11/28* (2006.01)

(52) U.S. Cl.
CPC ..... *A47L 11/4091* (2013.01); *A47L 11/28* (2013.01); *A47L 11/4011* (2013.01);
(Continued)

(58) Field of Classification Search
CPC ..... A47L 11/40; A47L 11/28; A47L 11/4091; A47L 11/4083; A47L 11/4011;
(Continued)

(56) References Cited

U.S. PATENT DOCUMENTS 2,116,979 A * 5/1938 Moller ..... B67C 11/02 141/334
2005/0083011 A1* 4/2005 Yang ..... B60L 53/31 320/107

(Continued)

FOREIGN PATENT DOCUMENTS

CN 108968835 A 12/2018
CN 110881900 A 3/2020

(Continued)

OTHER PUBLICATIONS

International Search Report of PCT Patent Application No. PCT/CN2021/135564 issued on Mar. 16, 2022.

*Primary Examiner* — Monica S Carter
*Assistant Examiner* — Kent N Shum
(74) *Attorney, Agent, or Firm* — IPRO, PLLC

(57) ABSTRACT

A maintenance station for maintaining a cleaning robot includes a housing, a cleaning structure, and a liquid supply assembly. The housing includes a guiding platform configured to guide the cleaning robot to park. The cleaning structure is arranged on the housing and positioned corresponding to the guiding platform. The cleaning structure includes a tank body and a cleaning protrusion. The tank body defines a groove, the cleaning protrusion is arranged in the groove, and the cleaning protrusion is configured to clean a cleaning piece of the cleaning robot. The liquid supply assembly is arranged on the housing, the liquid supply assembly defines a liquid supply port, the liquid supply port is positioned above the cleaning structure and configured to supply liquid that flows into the groove by gravity.

13 Claims, 7 Drawing Sheets

(52) U.S. Cl.
CPC ..... *A47L 11/4083* (2013.01); *A47L 2201/00* (2013.01); *A47L 2201/026* (2013.01); *A47L 2201/028* (2013.01)

(58) Field of Classification Search
CPC ..... A47L 2201/024; A47L 2201/026; A47L 9/00; A47L 9/28; A47L 11/24; A47L 2201/02; A47L 11/4025; A47L 2201/022
See application file for complete search history.

(56) References Cited

U.S. PATENT DOCUMENTS

| | | | | |
|---|---|---|---|---|
| 2019/0254495 | A1* | 8/2019 | Zhang | A47L 11/4013 |
| 2020/0077858 | A1* | 3/2020 | Zhang | A47L 11/4091 |
| 2020/0121153 | A1 | 4/2020 | Letsky | |
| 2021/0045573 | A1* | 2/2021 | De'Longhi | A47J 31/4428 |
| 2021/0282617 | A1* | 9/2021 | Deng | A47L 9/28 |
| 2021/0369072 | A1* | 12/2021 | Gao | B08B 3/02 |
| 2021/0393098 | A1* | 12/2021 | Pan | A47L 9/2873 |
| 2022/0117457 | A1* | 4/2022 | Wen | A47L 11/4025 |
| 2022/0142443 | A1* | 5/2022 | Wang | A47L 11/4083 |
| 2022/0338702 | A1* | 10/2022 | Wang | A47L 11/282 |
| 2022/0346619 | A1* | 11/2022 | Huang | A47L 11/4016 |
| 2023/0029165 | A1* | 1/2023 | Li | A47L 11/4041 |
| 2024/0000283 | A1* | 1/2024 | Brown | A47L 11/4038 |
| 2024/0049938 | A1* | 2/2024 | Li | A47L 11/292 |

FOREIGN PATENT DOCUMENTS

| | | | | |
|---|---|---|---|---|
| CN | 111759240 | A | | 10/2020 |
| CN | 212015459 | U | | 11/2020 |
| CN | 112006614 | A | * | 12/2020 |
| CN | 112022013 | A | | 12/2020 |
| CN | 112656319 | A | | 4/2021 |
| CN | 213155704 | U | | 5/2021 |
| JP | 2006158814 | A | * | 6/2006 |

* cited by examiner

MAINTENANCE STATION AND CLEANING SYSTEM

CROSS-REFERENCE TO RELATED APPLICATIONS

The present disclosure claims priority of Chinese Patent Application No. 202110661229.X, filed on Jun. 15, 2021, titled "maintenance station and cleaning system", the contents of which are incorporated herein by reference.

TECHNICAL FIELD

The present disclosure relates to the technical field of cleaning equipment, and in particular, relates to a maintenance station and a cleaning system.

BACKGROUND

With the continuous improvement of people's living standards, cleaning robots are becoming more and more popular, and intelligence thereof is developing from primary intelligence to higher intelligence, thereby gradually replacing traditional manual cleaning.

The cleaning robots can not only sweep the floor and collect the dust, but also mop and clean the floor. Specifically, the cleaning robots can perform wet cleaning on the floor through mops, turntable-type dishcloths or rollers provided at the bottom thereof. However, cleaning of the cleaning pieces such as mops, turntable-type dishcloths or rollers needs to be completed by a user, and during the whole process of cleaning the floor, the user needs to participate in changing the cleaning pieces. On the one hand, the user cannot be completely liberated from the whole process of cleaning the floor and the workload of the user is increased; and on the other hand, it is likely to affect the cleaning effect due to untimely change of the cleaning pieces such that the floor cannot be cleaned well.

In order to realize the automatic cleaning of the cleaning pieces of the cleaning robots, maintenance stations that can automatically clean the cleaning pieces described above have emerged in the industry. When it is necessary to clean the cleaning pieces, the cleaning robot will automatically move into the maintenance station, and the cleaning device in the maintenance station will automatically clean the cleaning pieces after it is detected that the cleaning robot is parked in place. The cleaning device in the maintenance station usually adopts an ultrasonic cleaning device, a rolling brush cleaning device or other cleaning devices. The ultrasonic cleaning device uses ultrasonic waves to clean the cleaning pieces together with clear water, the rolling brush cleaning device uses a driving mechanism to drive rolling brushes to rotate and scrape surfaces of the cleaning pieces, and other cleaning devices may use driving mechanisms to drive brushes to reciprocate and scrape the surfaces of the cleaning pieces. Obviously, installing a cleaning device in the maintenance station will result in a complex structure and increased cost.

SUMMARY

An embodiment of the present disclosure provides a maintenance station for maintaining a cleaning robot. The maintenance station includes a housing, a cleaning structure, and a liquid supply assembly. The housing includes a guiding platform configured to guide the cleaning robot to park. The cleaning structure is arranged on the housing and positioned corresponding to the guiding platform. The cleaning structure includes a tank body and a cleaning protrusion. The tank body defines a groove, the cleaning protrusion is arranged in the groove, and the cleaning protrusion is configured to clean a cleaning piece of the cleaning robot. The liquid supply assembly is arranged on the housing, the liquid supply assembly defines a liquid supply port, the liquid supply port is positioned above the cleaning structure and configured to supply liquid that flows into the groove by gravity.

BRIEF DESCRIPTION OF THE DRAWINGS

In order to explain embodiments of the present disclosure or technical solutions in the prior art more clearly, attached drawings required in the description of the embodiments or the prior art will be briefly introduced below. Obviously, the attached drawings in the following description are only some embodiments of the present disclosure. For those of ordinary skill in the art, other drawings can be obtained according to the structures shown in these attached drawings without creative labor.

The realization of the objective, functional features and advantages of the present disclosure will be further explained with reference to the attached drawings in combination with the embodiments.

DETAILED DESCRIPTION

Hereinafter, technical solutions in embodiments of the present disclosure will be described clearly and completely with reference to attached drawings in the embodiments of the present disclosure. Obviously, the embodiments described are only part but not all of the embodiments of the present disclosure. Based on the embodiments of the present disclosure, all other embodiments obtained by those of ordinary skill in the art without creative labor belong to the scope claimed in the present disclosure.

It shall be noted that, all directional indicators (such as up, down, left, right, front, back and so on) in the embodiment of the present disclosure are only used to explain relative position relationships and movement situations among components in a specific posture (as shown in the attached drawing). If the specific posture changes, the directional indicators will change accordingly.

In addition, in the present disclosure, descriptions such as "first", "second" or the like are only configured to descriptive purposes, and should not be understood as indicating or implying the relative importance thereof or implicitly indicating the number of indicated technical features. Therefore, features defined with "first" and "second" may explicitly or implicitly include at least one of the features. In addition, technical solutions among the embodiments may be combined with each other on the basis that they can be realized by those of ordinary skill in the art. When the combination of the technical solutions is contradictory or impossible to be realized, it should be considered that such combination of the technical solutions does not exist, nor is it within the scope claimed in the present disclosure.

Figure 1:
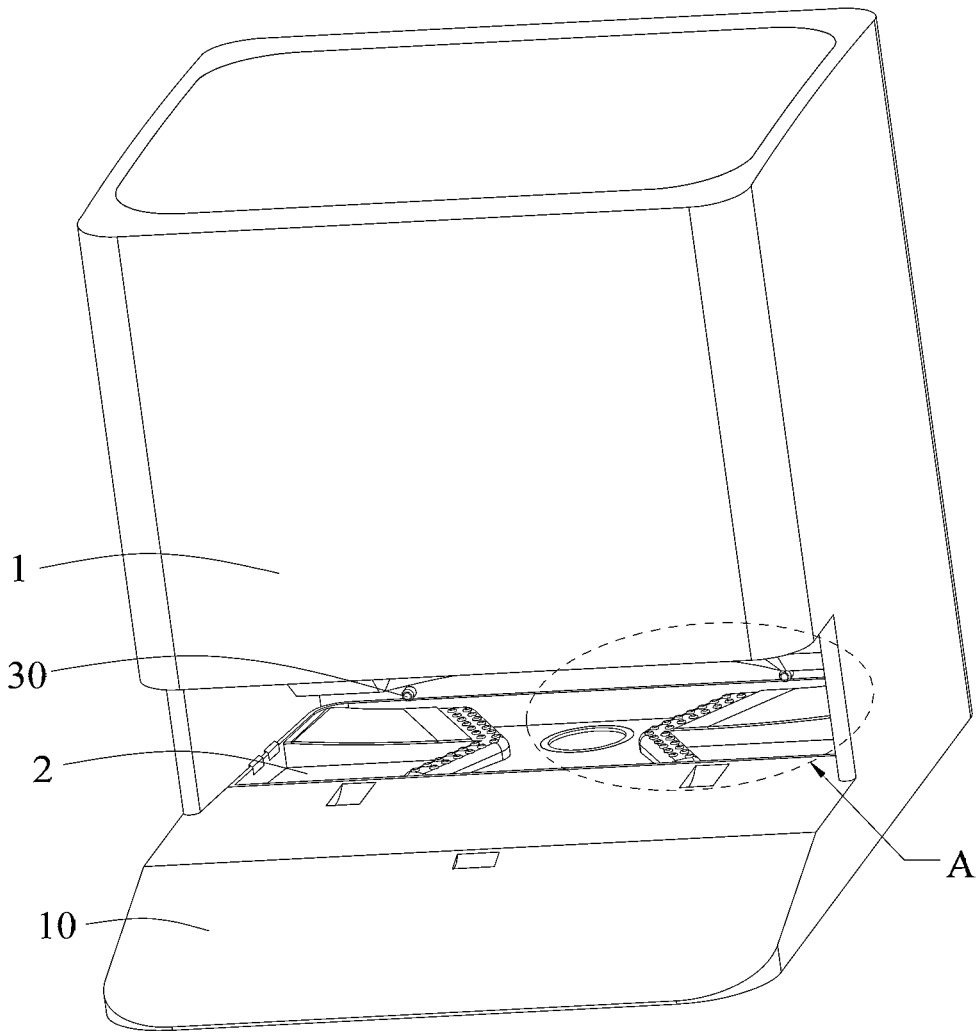
FIG. 1 is a schematic structural diagram of a maintenance station according to an embodiment of the present disclosure.
Figure 2:
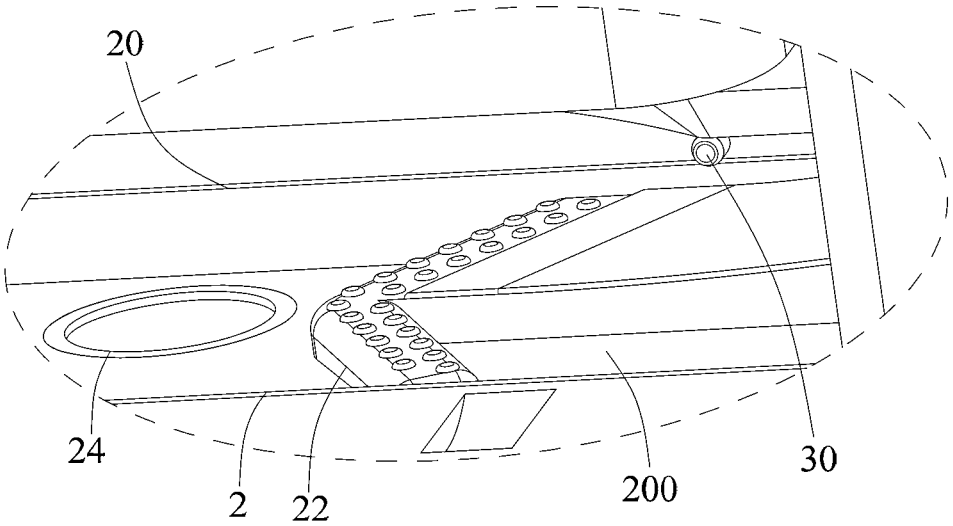
FIG. 2 is an enlarged view of an area A in FIG. 1.
Figure 3:
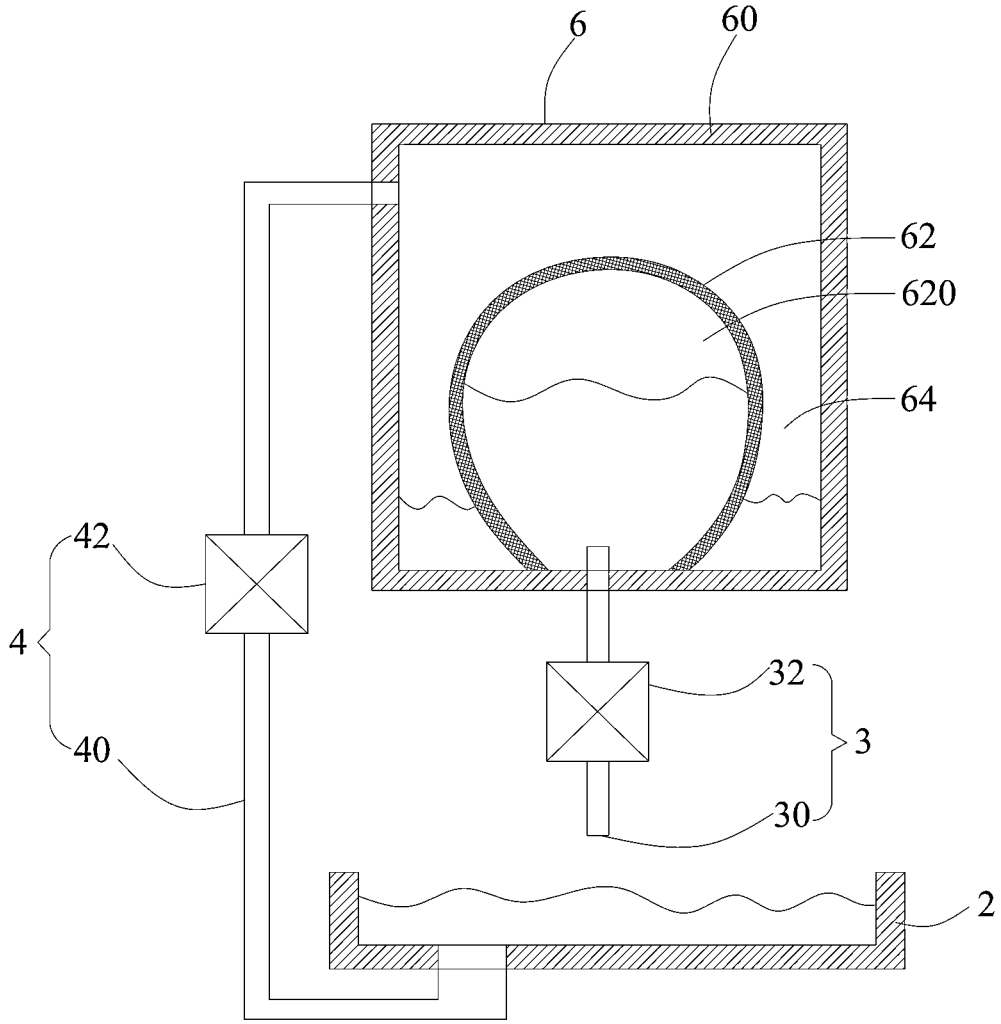
FIG. 3 is a schematic diagram of the maintenance station in FIG. 1.

An embodiment of the present disclosure provides a maintenance station for maintaining a cleaning robot. Referring to FIG. 1 to FIG. 3, in an embodiment, the maintenance station includes a housing 1, a cleaning structure 2 and a liquid supply assembly 3. The housing 1 includes a guiding platform 10 configured to guide the cleaning robot to park. That is, when the cleaning robot is to be parked at the maintenance station, the cleaning robot runs on the guiding platform 10 and stops at a preset position under the guidance of the guiding platform 10. The cleaning structure 2 is arranged in the housing 1 and is positioned corresponding to the guiding platform 10. The cleaning structure 2 includes a tank body 20 and a cleaning protrusion 22, wherein the tank body 20 defines a groove 200, the cleaning protrusion 22 is arranged in the groove 200, and the cleaning protrusions 22 are configured to clean the cleaning pieces of the cleaning robot. The liquid supply assembly 3 is arranged in the housing 1 and defines a liquid supply port 30, the liquid supply port 30 is located above the cleaning structure 2 and is configured to supply liquid which flows into the groove 200 by gravity.

In this embodiment, the maintenance station cleans the cleaning pieces of the cleaning robot through the cleaning protrusion 22 and the liquid provided by the liquid supply port 30 of the liquid supply assembly 3. In the cleaning process, the cleaning pieces are driven to move by the power mechanism of the cleaning robot itself, and then rubbed against the cleaning protrusion 22 to be cleaned. Therefore, the maintenance station in this embodiment does not need to be provided with a cleaning device, which simplifies the structure and reduces the cost. Specifically, when the cleaning pieces of the cleaning robot need to be cleaned, the cleaning robot moves into the maintenance station through the guiding platform 10, and stops at the preset position. At this point, the cleaning pieces are located in the groove 200 and contact with the cleaning protrusion 22, and the liquid supply port 30 of the liquid supply assembly 3 provides cleaning liquid to wet the cleaning pieces. The cleaning robot controls the cleaning pieces thereon to move such that the cleaning pieces rub against the cleaning protrusion 22 to scrape and brush off the dirt and waste liquid thereon.

It shall be noted that in the present disclosure, the power mechanism of the cleaning robot may be, but is not limited to, a turntable drive assembly, a roller drive assembly, a mop motion mechanism or a mop vibration assembly. When the power mechanism is a turntable drive assembly, the cleaning piece is disc-shaped and installed on the turntable of the turntable drive assembly, and the cleaning pieces are driven to rotate by driving the turntable to rotate. When the power mechanism is a roller drive assembly, the cleaning pieces are roller-shaped and axially connected with the roller drive assembly, and the roller drive assembly drives the cleaning pieces to rotate. When the power mechanism is a mop motion mechanism, the cleaning pieces are block-shaped mops and are installed on the mop motion mechanism, and the mop motion mechanism drives the cleaning pieces to move back and forth. When the power mechanism is a mop vibration assembly, the cleaning pieces are block-shaped mops and installed on the vibration pallet of the mop vibration assembly, and the mops are driven to vibrate through the vibration of the vibration pallet. To say the least, the power mechanism may also be a driving wheel assembly, which drives the cleaning robot to move back and forth in the maintenance station, and then drives the cleaning pieces on the cleaning robot to move in the groove 200.

In this embodiment, the cleaning structure 2 further includes a liquid outlet structure 24, which is arranged in the tank body 20 and communicates with the groove 200. The liquid outlet structure 24 is configured to discharge the liquid in the groove 200 to the outside of the cleaning structure 2. The liquid outlet structure 24 discharges the waste liquid generated by cleaning the cleaning pieces to the outside of the groove 200, thereby ensuring the cleaning effect. However, in other embodiments, the liquid in the groove 200 may be directly discharged by a liquid discharging device of the maintenance station. That is, a liquid discharging pipe of the liquid discharging device extends into the groove 200 from above the cleaning structure 2, and thus it is unnecessary to provide the above-mentioned liquid outlet structure 24 on the cleaning structure 2.

It shall be understood that in the present disclosure, the liquid outlet structure 24 may be a liquid outlet hole arranged on the bottom wall of the tank body 20, and the liquid flows out of the groove 200 through the liquid outlet hole under the action of gravity. The liquid outlet structure 24 may also be a liquid outlet channel arranged on the sidewall of the tank body 20, and the liquid outlet channel communicates with the groove 200 to discharge the liquid.

In this embodiment, the liquid outlet structure 24 is arranged on the bottom wall of the tank body 20, and the liquid outlet structure 24 is a liquid outlet strainer. The waste liquid generated after cleaning is discharged through the liquid outlet strainer, but the solid garbage in the waste liquid stays on the liquid outlet strainer, so as to avoid the blockage of the liquid discharging part by large particles of garbage. Because the liquid outlet strainer may discharge the waste liquid at any time, this embodiment applies running water to clean the cleaning pieces. That is, the waste liquid generated after cleaning is discharged while performing the cleaning operation, which provides a good cleaning effect and may discharge the waste liquid in time. However, in other embodiments, the cleaning pieces may be cleaned by immersion. When immersion cleaning is adopted, the cleaning structure 2 may not be provided with the liquid outlet structure 24 or a liquid storage structure may be provided below the liquid outlet structure 24, the liquid storage structure stores liquid therein and it is drained only when the cleaning piece is soaked in the liquid level.

In this embodiment, the cleaning structure 2 further includes a liquid supply boss 26, which is arranged in the groove 200 and below the liquid supply port 30. The liquid passes through the upper surface of the liquid supply boss 26, and the upper surface is configured to contact at least a part of the cleaning piece. When the cleaning liquid is output from the liquid supply port 30, the cleaning liquid flows to the upper surface of the liquid supply boss 26 under the action of gravity and flows onto the cleaning piece through the upper surface to wet the cleaning piece, because at least a part of the cleaning piece is located on the upper surface of the liquid supply boss 26. The liquid supply boss 26 provides a platform for liquid dispersion, which makes the cleaning piece be better wet. At the same time, in cooperation with the liquid outlet structure 24, the liquid supply boss 26 supplies cleaning liquid to clean the cleaning pieces, and the liquid flows down from the liquid supply boss 26 and is discharged from the liquid outlet structure 24. In this way, the cleaning pieces may be cleaned while being wet, and the cleaning liquid is continuously updated. In addition, the cleaning mode using running water of discharging waste liquid while cleaning is realized, which makes the cleaning more efficient, thorough and cleaner.

It shall be noted that, in other embodiments, the cleaning pieces may also be cleaned with running water by spraying water. That is, a water spraying structure is arranged on the cleaning structure 2, the water spraying structure directly sprays the cleaning liquid onto the cleaning pieces, and the waste liquid generated after cleaning is also discharged through the liquid outlet structure 24.

Figure 4:
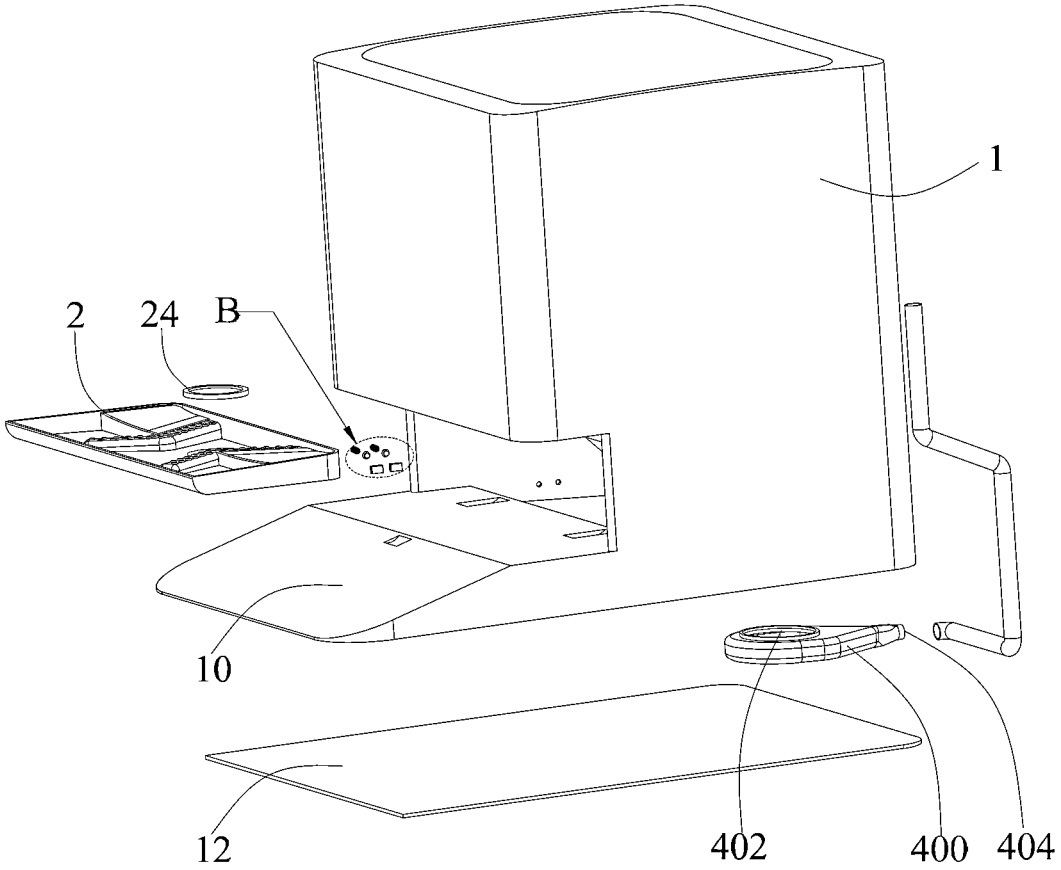
FIG. 4 is an exploded view of the maintenance station in FIG. 1.
Figure 5:
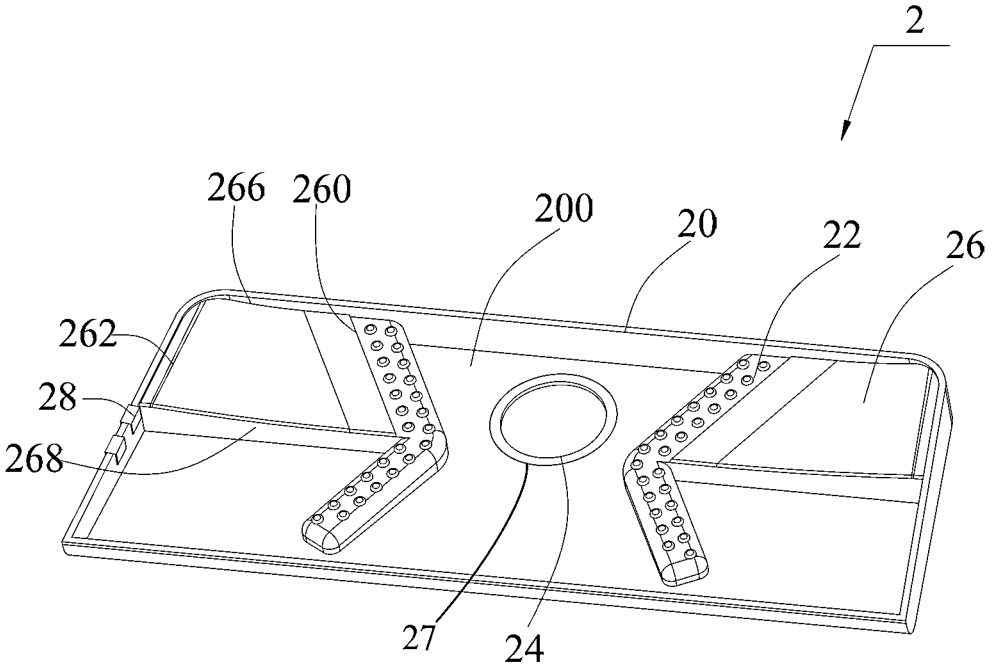
FIG. 5 is a schematic structural diagram of a cleaning structure of the maintenance station in FIG. 1.

Referring to FIG. 4 and FIG. 5, in this embodiment, the liquid supply boss 26 includes a proximal end 260 and a distal end 262. The proximal end 260 is connected with the cleaning protrusion 22 and is lower than the cleaning protrusion 22 relative to the bottom wall of the tank body 20. The distal end 262 is positioned away from the cleaning protrusion 22. The upper surface of the liquid supply boss 26 is arranged obliquely downward in the direction from the distal end 262 to the proximal end 260. Since the distal end 262 of the liquid supply boss 26 is higher than the proximal end 260, and the upper surface of the liquid supply boss 26 inclines downward toward the cleaning protrusion 22, the upper surface of the liquid supply boss 26 plays a role of guiding the liquid to the cleaning protrusion 22. At the same time, since the cleaning protrusion 22 is higher than the proximal end 260, the cleaning protrusions 22 may act as a water barrier. The cleaning piece contacts with the cleaning protrusion 22 and the liquid supply boss 26, such that the cleaning liquid fully wets the cleaning piece, thereby improving the cleaning effect of the cleaning liquid and the cleaning protrusion 22 on the cleaning piece.

Figure 6:
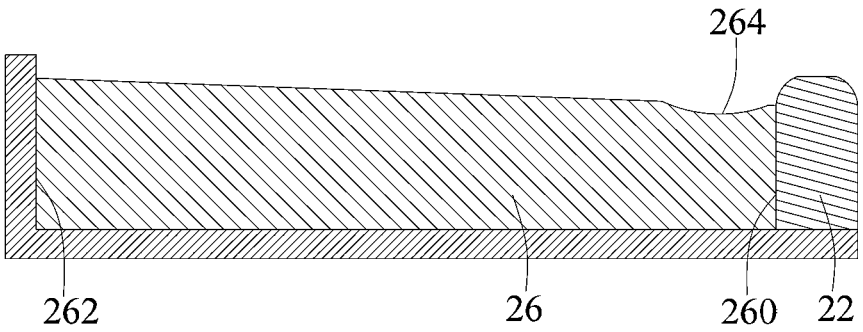
FIG. 6 is a partial cross-sectional view of the cleaning structure in FIG. 5.

Referring to FIG. 6, further, the upper surface of the liquid supply boss 26 is provided with a concave part 264, and the concave part 264 is arranged close to or in contact with the cleaning protrusion 22. Obviously, the concave part 264 plays the role of liquid storage. Because the concave part 264 is close to or in contact with the cleaning protrusion 22, the cleaning piece on the cleaning protrusion 22 fully contacts the liquid stored in the concave part 264, thereby ensuring the supply of cleaning liquid without affecting the fluidity.

Specifically, the liquid supply boss 26 further includes a proximal side 266 and a distal side 268. The proximal side 266 is close to the liquid supply port 30 and connected to one sidewall of the tank body 20, while the distal end 262 is connected to another sidewall of the tank body 20, such that the liquid supply boss 26 is located at the corner position of the groove 200, and the distal side 268 is positioned away from the liquid supply port 30. The upper surface of the liquid supply boss 26 is arranged obliquely downward in the direction from the distal side 268 to the proximal side 266. Since the distal side 268 of the liquid supply boss 26 is higher than the proximal side 266, the liquid is guided to the sidewall of the tank body 20. Meanwhile, the sidewall of the tank body 20, the distal side 268 of the liquid supply boss 26 and the cleaning protrusion 22 cooperatively enclose to form a concave structure. In this way, more cleaning liquid may be stored on the upper surface of the liquid supply boss 26, and the cleaning efficiency of the cleaning liquid is further improved on the premise of ensuring fluidity.

Referring to FIG. 5, in this embodiment, the cleaning structure 2 includes two cleaning protrusions 22 and two liquid supply bosses 26, the two liquid supply bosses 26 are respectively located at one side of the groove 200, and the two cleaning protrusions 22 are arranged at intervals and positioned between the two liquid supply bosses 26. The liquid supply assembly 3 defines two liquid supply ports 30, and each of the liquid supply ports 30 is arranged corresponding to a respective one of the liquid supply bosses 26. Correspondingly, the cleaning robot includes two turntable cleaning assemblies, namely left and right turntable cleaning assemblies. The cleaning piece of the left turntable assembly is cleaned by the cleaning protrusion 22 and the liquid supply boss 26 on one side of the groove 200, while the cleaning piece of the right turntable assembly is cleaned by the cleaning protrusion 22 and the liquid supply boss 26 on the other side of the groove 200.

Further, the bottom wall of the tank body 20 defines a liquid outlet hole 27, the liquid outlet hole 27 is located between the two cleaning protrusions 22, and a liquid outlet strainer is installed in the liquid outlet hole 27. The upper surface of the bottom wall of the tank body 20 is arranged obliquely upward along the radially outward direction of the liquid outlet hole, such that the liquid on the bottom wall of the tank body 20 converges toward the liquid outlet hole. In this way, it is ensured that the waste liquid may be discharged completely, thereby reducing or avoiding the accumulation of the waste liquid in the groove 200, and reducing or overcoming the moldy and smelly situation of the cleaning structure 2.

Further, the upper surface of each cleaning protrusion 22 is provided with a plurality of protrusions (not labeled), and the protrusions can enhance the friction with the cleaning piece and improve the cleaning effect of the cleaning piece.

Referring to FIG. 3 and FIG. 4, in this embodiment, the maintenance station further includes a liquid discharging assembly 4, and the liquid discharging assembly 4 is arranged in the housing 1. The liquid discharging assembly 4 includes a liquid discharging pipeline 40, the liquid discharging pipeline 40 includes a liquid storage section 400, the liquid storage section 400 defines an inlet 402 and an outlet 404, and the inlet 402 communicates with the liquid outlet structure 24. The liquid storage section 400 may store the waste liquid, and the waste water in the cleaning structure 2 flows to the liquid discharging assembly 4 to be discharged after being filtered, thereby avoiding the problems of dirt deposition and difficulty in cleaning of the cleaning structure 2. When the waste liquid is stored to a certain amount, the waste liquid is pumped and discharged, such that the waste liquid during cleaning may be temporarily stored in the liquid discharging pipeline 40 and pumped after it is accumulated to a certain amount, which may save electric energy and reduce the noise duration during motor operation.

Furthermore, the liquid storage section 400 has a geometric shape that gradually decreases from large to the outlet 404, such that more liquid may be stored.

In this embodiment, the cleaning structure 2 is detachably arranged and is separated from the above liquid supply port 30 at intervals. At the same time, the liquid discharging hole of the cleaning structure 2 is detachably butted with the inlet 402 of the liquid storage section 400, which is convenient for the user to disassemble the cleaning structure 2 from the housing 1 to clean the cleaning structure 2, and the cleaning is more convenient and thorough. It shall be noted that in other embodiments, the cleaning structure 2 may be non-detachably arranged in the housing 1.

Figure 7:
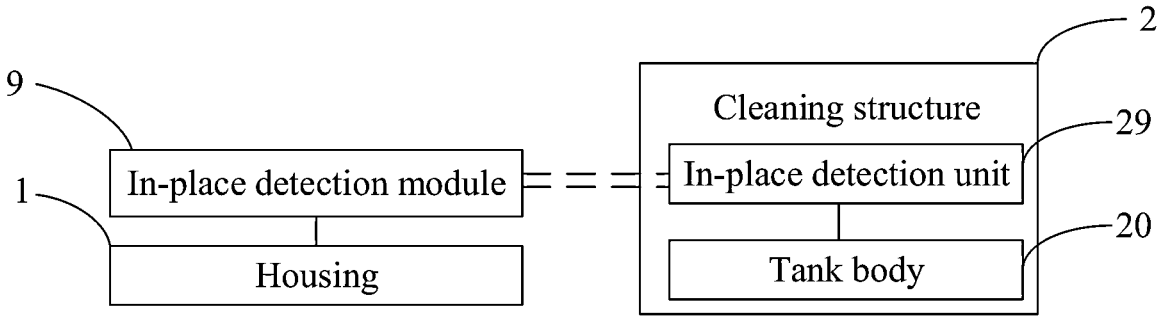
FIG. 7 is a schematic diagram showing the relationship between an in-place detection module and an in-place detection module of the maintenance station.

Referring to FIG. 7, in this embodiment, the maintenance station further includes an in-place detection module 9, and the in-place detection module 9 is arranged in the housing 1. The cleaning structure 2 further includes an in-place detection unit 29, and the in-place detection unit 29 is arranged in the tank body 20 and cooperates with the in-place detection module 9 to perform in-place detection. When the cleaning structure 2 is installed at the preset position of the housing 1, the in-place detection module 9 may detect the in-place detection unit 29 and determines that the cleaning structure 2 is installed in place. When the cleaning structure 2 is not installed or is installed improperly, the in-place detection module 9 cannot detect the in-place detection unit 29, and then determines that the cleaning structure 2 is installed abnormally, and sends an abnormal signal to the user.

Further, the in-place detection module 9 is a Hall detection module, and the in-place detection unit 29 is a magnet.

Figure 8:
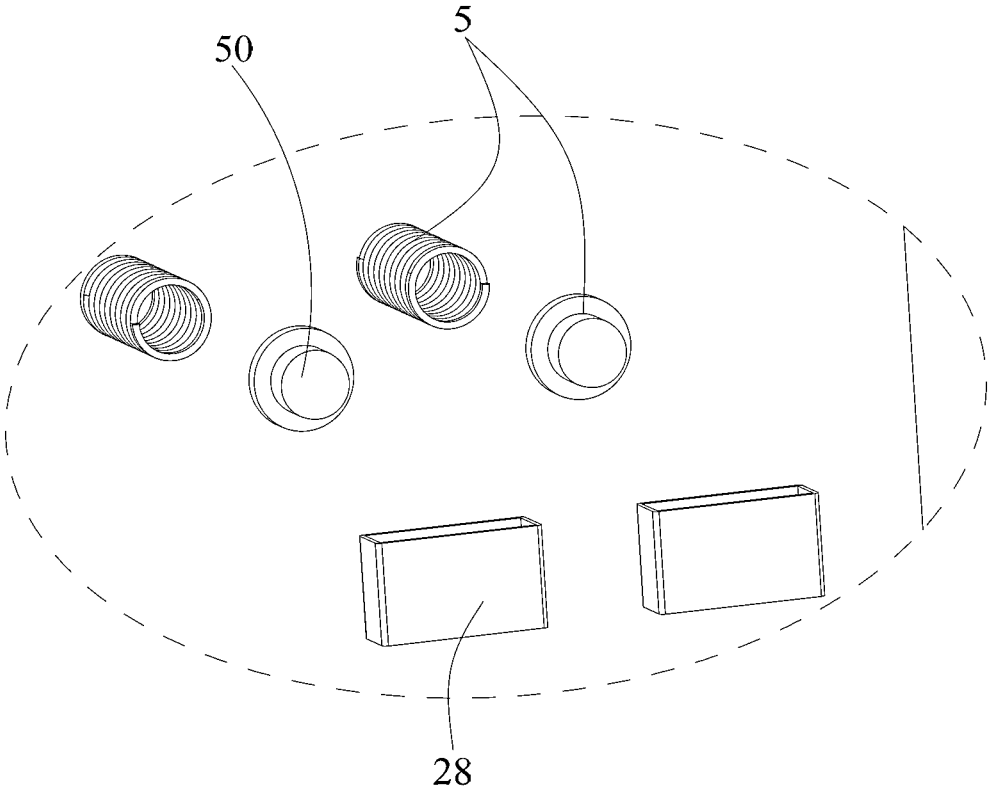
FIG. 8 is an enlarged view of an area B of the maintenance station in FIG. 4.

Referring to FIG. 4 and FIG. 8, in this embodiment, the maintenance station further includes a liquid level detection module 5, and the liquid level detection module 5 is arranged in the housing 1. The liquid level detection module 5 includes a convex column 50, and the convex column 50 is located on the sidewall of the housing 1 and is elastically retractable relative to the sidewall of the housing 1. The cleaning structure 2 further includes a liquid level detection pole piece 28, and the liquid level detection pole piece 28 is arranged on the tank body 20 and electrically connected with the convex column 50. When the liquid level in the groove 200 reaches the preset position, the liquid level detection pole piece 28 is turned on by the liquid, so as to determine the liquid level, and control the liquid discharging assembly 4 to discharge the liquid, thus avoiding the overflow of the liquid. In addition, the convex column 50 is telescopically arranged, such that when the cleaning structure 2 is installed, good contact between the liquid level detection pole piece 28 and the convex column 50 can be ensured, thereby ensuring stable electrical connection.

Referring to FIG. 3, in this embodiment, the maintenance station further includes a liquid box 6, and the liquid box 6 is positioned in the housing 1. The liquid box 6 includes a box body 60 and a liquid capsule 62 arranged in the box body 60, the liquid capsule 62 includes a first liquid storage cavity 620 with a variable volume, and the first liquid storage cavity 620 is configured to store clear water or cleaning liquid. A second liquid storage cavity 64 is formed between the box body 60 and the liquid capsule 62, and the second liquid storage cavity 64 is configured to store the waste liquid generated after cleaning. The first liquid storage cavity 620 communicates with the liquid supply assembly 3, and the liquid in the first liquid storage cavity 620 is output to the groove 200 through the liquid supply assembly 3. The liquid discharging assembly 4 respectively communicates with the groove 200 and the second liquid storage cavity 64, and the liquid in the groove 200 flows into the second liquid storage cavity 64 through the liquid discharging assembly 4.

When the liquid supply assembly 3 supplies cleaning liquid to the groove 200 of the cleaning structure 2, the liquid stored in the liquid capsule 62 decreases, and its volume shrinks, while the volume of the second liquid storage cavity 64 increases. The waste liquid generated by cleaning the cleaning piece enters the second liquid storage cavity 64 under the action of the liquid discharge assembly 4, thereby realizing the dynamic change of the clean liquid volume and the waste liquid volume, improving the liquid storage capacity, eliminating the need to use a waste liquid tank and a clear water tank at the same time, and reducing the cost.

Further, the liquid supply assembly 3 further includes a first water pump 32. The first water pump 32 is respectively communicated with the first liquid storage cavity 620 and the liquid supply port 30 through pipelines, so as to convey the liquid in the liquid capsule 62 to the liquid supply port 30 and discharge the liquid through the liquid supply port 30. The liquid capsule 62 may include a liquid replenishing port or a liquid replenishing pipe communicating with the first liquid storage cavity 620 to replenish cleaning liquid or clear water from the outside.

Furthermore, the liquid discharging assembly 4 further includes a second water pump 42, and the second water pump 42 respectively communicates with the outlet 404 of the liquid storage section 400 and the second liquid storage cavity 64 through pipelines to pump the waste liquid generated after cleaning into the second liquid storage cavity 64. When the waste liquid in the second liquid storage cavity 64 needs to be discharged, the upper cover of the liquid box 6 may be opened to pour out the waste liquid or a liquid discharging hose is provided to discharge the waste liquid.

It shall be understood that, in other embodiments of the present disclosure, the liquid box 6 may be replaced by a clear water box and a waste liquid box. In other words, the liquid supply assembly 3 further includes a clear water box, and the clear water box communicates with the first water pump 32. The liquid discharging assembly 4 further includes a waste liquid box, and the waste liquid box communicates with the second water pump 42.

Referring to FIG. 4, in this embodiment, the housing 1 of the maintenance station includes a baseplate 12, the guiding platform 10 includes a guiding inclined plane, and the guiding inclined plane is arranged obliquely upward and defines a wheel groove.

Figure 9:
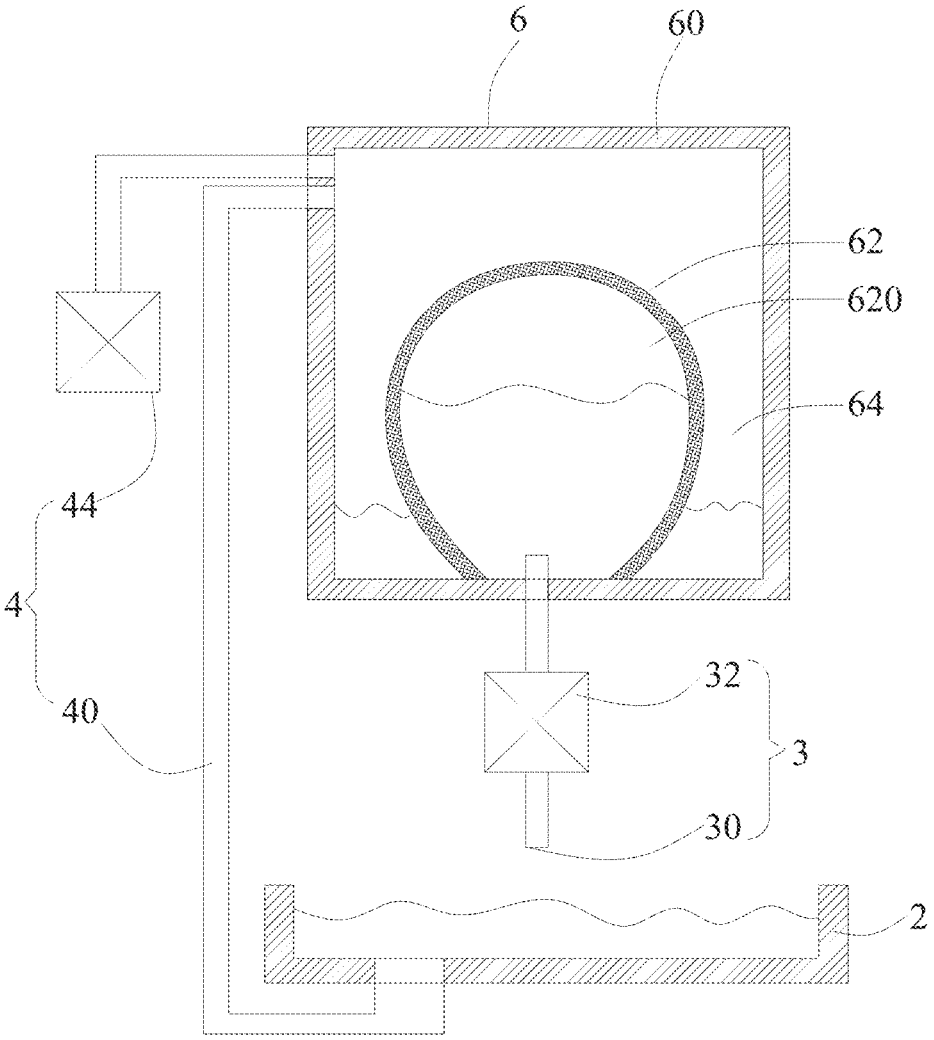
FIG. 9 is a schematic diagram of the maintenance station according to another embodiment of the present disclosure.

Referring to FIG. 9, the present disclosure further provides another embodiment of the maintenance station. The maintenance station of this embodiment is similar to the maintenance station of the above embodiment, except that:

the second water pump 42 of the liquid discharging assembly 4 is replaced by an air pump 44, and is directly communicated with the outlet of the storage section 400 and the second liquid storage cavity 64 through pipelines. The air pump 44 communicates with the second liquid storage cavity 64 through other pipelines and empties the air in the second liquid storage cavity 64, thus gradually forming negative pressure in the second liquid storage cavity 64. Under the action of air pressure, the waste liquid from the groove 200 flows into the second liquid storage cavity 64 through pipelines.

Other aspects of the maintenance station of this embodiment are basically the same as those of the maintenance station of the above embodiment, and basically the same technical effects may be achieved, and this will not be further described herein.

Figure 10:
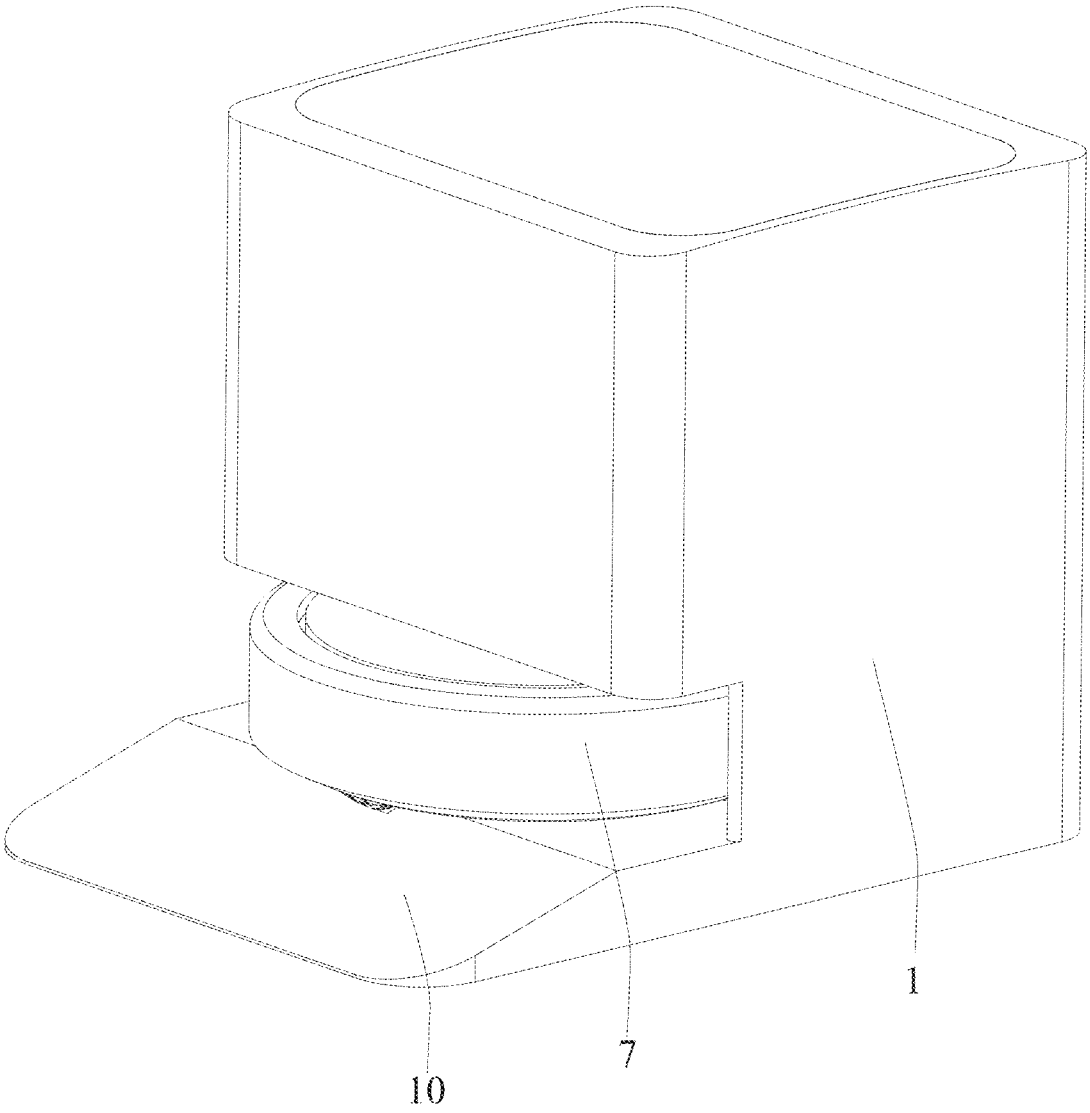
FIG. 10 is a schematic structural diagram of a cleaning system according to an embodiment of the present disclosure.
Figure 11:
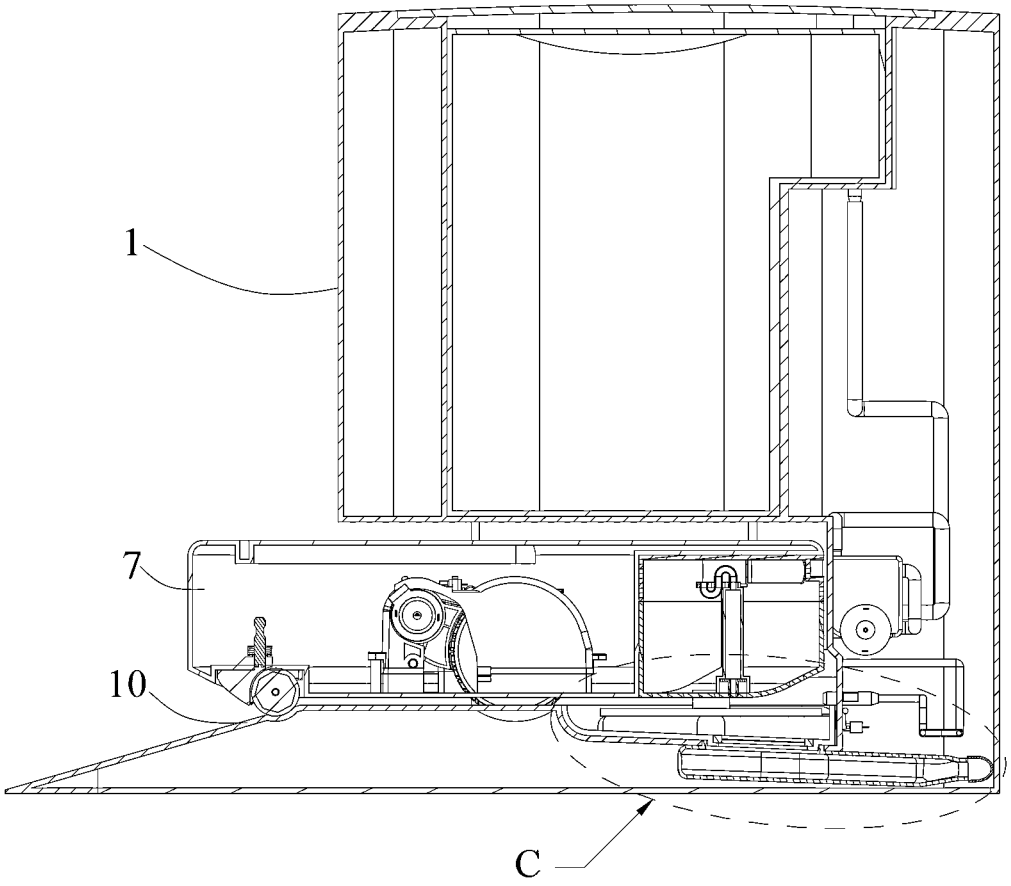
FIG. 11 is a cross-sectional view of the cleaning system in FIG. 10.
Figure 12:
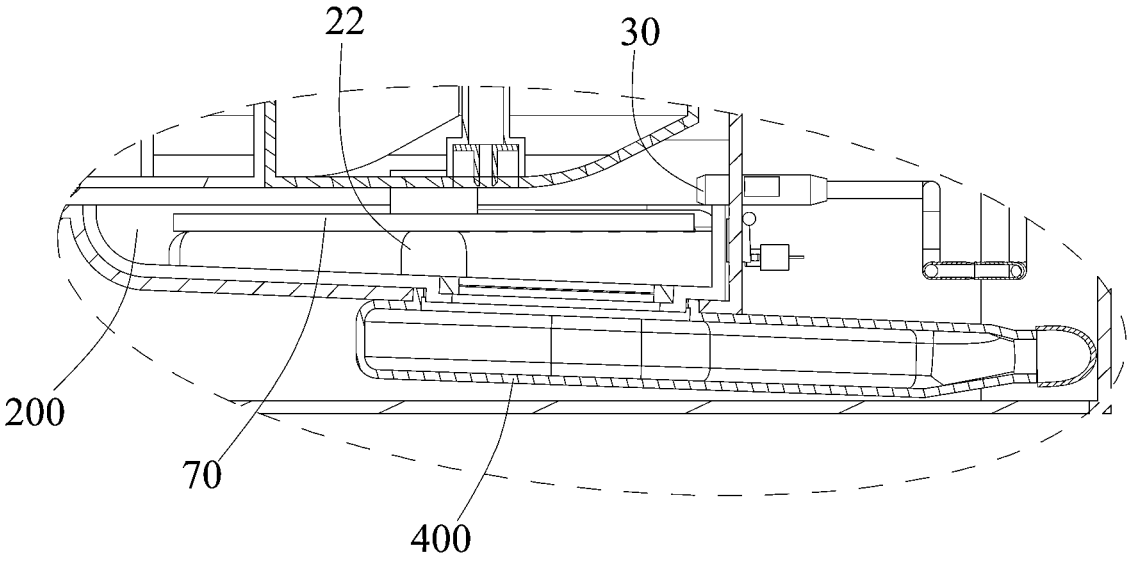
FIG. 12 is an enlarged view of an area C of the cleaning system in FIG. 11.

The present disclosure further provides a cleaning system. Referring to FIG. 10 to FIG. 12, the cleaning system includes a maintenance station and a cleaning robot 7, the cleaning robot 7 may park in the maintenance station by itself, and the maintenance station maintains the cleaning robot parked therein. That is, the maintenance station may realize at least one function of charging, cleaning the cleaning pieces and discharging the dust box. The maintenance station of the cleaning system in this embodiment adopts all the technical solutions of the maintenance station in the above embodiments, and thus it also has all the beneficial effects brought by the technical solutions of the maintenance station in the above embodiment, and this will not be further described herein.

In this embodiment, the cleaning robot 7 includes two turntable cleaning assemblies, which mop the floor through the rotation of cleaning pieces on the turntable cleaning assemblies so as to clean the floor. However, in other embodiments, the cleaning robot may include a roller cleaning assembly, a mop cleaning assembly or a crawler cleaning assembly.

In this embodiment, when the cleaning robot is parked in the maintenance station to clean the cleaning pieces, the cleaning piece 70 on the turntable is located in the groove 200 and above the cleaning protrusion 22 to contact with the cleaning protrusion 22. The liquid supply port 30 of the liquid supply assembly 3 supplies cleaning liquid, and the cleaning liquid flows onto the cleaning piece 70 through the upper surface of the liquid supply boss 26. The cleaning piece 70 continuously rotates and rubs against the cleaning protrusion 22 while the cleaning liquid continuously wets the cleaning piece, and the liquid generated after the cleaning flows down from the liquid supply boss 26 and is discharged from the liquid outlet structure 24.

What described above are only the exemplary embodiments of the present disclosure, but are not intended to limit the scope of the present disclosure. Under the concept of the present disclosure, any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A maintenance station for maintaining a cleaning robot, comprising:

a housing comprising a guiding platform configured to guide the cleaning robot to park;

a cleaning structure arranged on the housing and positioned corresponding to the guiding platform, the cleaning structure comprising a tank body and a cleaning protrusion, the tank body defining a groove, the cleaning protrusion arranged in the groove, and the cleaning protrusion configured to clean a cleaning piece of the cleaning robot; and a liquid supply assembly arranged on the housing, the liquid supply assembly defining a liquid supply port, the liquid supply port configured to supply liquid that flows into the groove by gravity;

wherein the cleaning structure further comprises a liquid supply boss, and the liquid supply boss is arranged in the groove and below the liquid supply port;

the liquid supply boss comprises an upper surface, the upper surface is configured to allow the liquid to pass therethrough and configured to contact with at least a part of the cleaning piece;

the liquid supply boss comprises a proximal end and a distal end, the proximal end is connected with the cleaning protrusion and is lower than the cleaning protrusion relative to a bottom wall of the tank body, and the distal end is arranged away from the cleaning protrusion;

the upper surface of the liquid supply boss is arranged obliquely downward in the direction from the distal end to the proximal end;

the cleaning protrusion comprises a first part and a second part, an end of the first part and an end of the second part are directly connected to each other, and the first part and the second part are arranged in an obtuse angle;

the liquid supply boss comprises a distal side and a proximal side, the distal side is arranged away from the liquid supply port, an end of the distal side is directly connected to an intersection of the first part and the second part, the proximal side is opposite to the distal side, the proximal side is close to the liquid supply port and connected with a first sidewall of the tank body, the distal end is connected with a second sidewall of the tank body, such that the liquid supply boss is located at a corner position of the groove, another end of the distal side is directly connected to the second sidewall and the distal end, another end of the first part is directly connected to the first sidewall and an end of the proximal side, the first sidewall, the second sidewall, the distal side and the first part cooperatively enclose to form a concave structure;

the upper surface of the liquid supply boss is arranged obliquely downward in the direction from the distal side to the proximal side.

2. The maintenance station of claim 1, wherein the cleaning structure comprises two cleaning protrusions and two liquid supply bosses, the two liquid supply bosses are individually positioned at one side of the groove, and the two cleaning protrusions are arranged at intervals and positioned between the two liquid supply bosses;

the liquid supply assembly defines two liquid supply ports, and each of the liquid supply ports is arranged corresponding to a respective one of the liquid supply bosses.

3. The maintenance station of claim 2, wherein the bottom wall of the tank body defines a liquid outlet hole, the liquid outlet hole is located between the two cleaning protrusions, and an upper surface of the bottom wall of the tank body is arranged obliquely upward in a radially outward direction of the liquid outlet hole.

4. The maintenance station of claim 1, wherein the cleaning structure further comprises a liquid outlet structure, the liquid outlet structure is arranged in the tank body and communicated with the groove, and the liquid outlet structure is configured to discharge liquid in the groove to an outside of the cleaning structure.

5. The maintenance station of claim 4, wherein the liquid outlet structure is arranged on a bottom wall of the tank body, and the liquid outlet structure comprise a liquid outlet strainer.

6. The maintenance station of claim 4, further comprising:

a liquid discharging assembly arranged on the housing, the liquid discharging assembly comprising a liquid discharging pipeline, the liquid discharging pipeline comprises a liquid storage section, the liquid storage section defines an inlet and an outlet, and the inlet is communicated with the liquid outlet structure.

7. The maintenance station of claim 6, wherein the liquid storage section comprises a geometric shape that gradually decreases in size towards the outlet.

8. The maintenance station of claim 1, wherein the cleaning structure is detachably arranged.

9. The maintenance station of claim 8, further comprising:

an in-place detection module arranged on the housing;

the cleaning structure comprising an in-place detection unit, the in-place detection unit arranged on the tank body, and the in-place detection unit cooperating with the in-place detection module.

10. The maintenance station of claim 8, further comprising:

a liquid level detection module arranged on the housing, the liquid level detection module comprising a convex column, and the convex column positioned on a sidewall of the housing and elastically retractable relative to the sidewall of the housing;

the cleaning structure further comprising a liquid level detection pole piece, and the liquid level detection pole piece arranged on the tank body and electrically connected with the convex column.

11. The maintenance station of claim 1, further comprising:

a liquid box arranged on the housing and comprising a box body and a liquid capsule arranged in the box body, the liquid capsule defining a first liquid storage cavity with a variable volume, the box body and the liquid capsule cooperatively defining a second liquid storage cavity therebetween, the first liquid storage cavity communicated with the liquid supply assembly, and liquid in the first liquid storage cavity capable of being output to the groove through the liquid supply assembly; and a liquid discharging assembly respectively communicated with the groove and the second liquid storage cavity, and liquid in the groove capable of flowing into the second liquid storage cavity under an action of the liquid discharging assembly.

12. A cleaning system comprising a cleaning robot and the maintenance station of claim 1, the maintenance station configured to maintain the cleaning robot.

13. The maintenance station of claim 1, wherein the liquid supply port is positioned above the tank body and the cleaning protrusion.

* * * * *